United States Patent [19]

McQuade

[11] 4,445,723

[45] May 1, 1984

[54] METHOD OF CIRCLE MINING OF ORE

[76] Inventor: Paul D. McQuade, 147 Woodside Dr., Greenwich, Conn. 06830

[21] Appl. No.: 402,093

[22] Filed: Jul. 26, 1982

[51] Int. Cl.[3] ..... E21C 41/00

[52] U.S. Cl. ..... 299/11; 299/18; 299/19

[58] Field of Search ..... 299/10, 11, 18, 19, 299/33; 37/195

[56] References Cited

U.S. PATENT DOCUMENTS 3,975,053 8/1976 Kochanowsky ..... 299/19 X
4,232,904 11/1980 Hurd ..... 299/18
4,391,470 7/1983 Langenberg et al. ..... 299/11

FOREIGN PATENT DOCUMENTS 563525 1/1958 Belgium ..... 299/10

*Primary Examiner*—Ernest R. Purser
*Attorney, Agent, or Firm*—Alfred E. Miller

[57] ABSTRACT

A circular mining process for deep mining in which a substantially circular tunnel is cut in the mountain against the advancing continuous face of the mine. As coal is cut from the face and hauled outside, additional strata from below the coal, which includes rock and stone are piled and packed to the ceiling against the opposite wall to serve as a roof support. Vehicles with special implements move in one direction only and cut the advance wall, gather the mined ore, and haul the mined ore, as well as rock and stone to a clearing out of the mine on the side of the mountain, and adjacent to the portals of the circular passageway.

5 Claims, 8 Drawing Figures

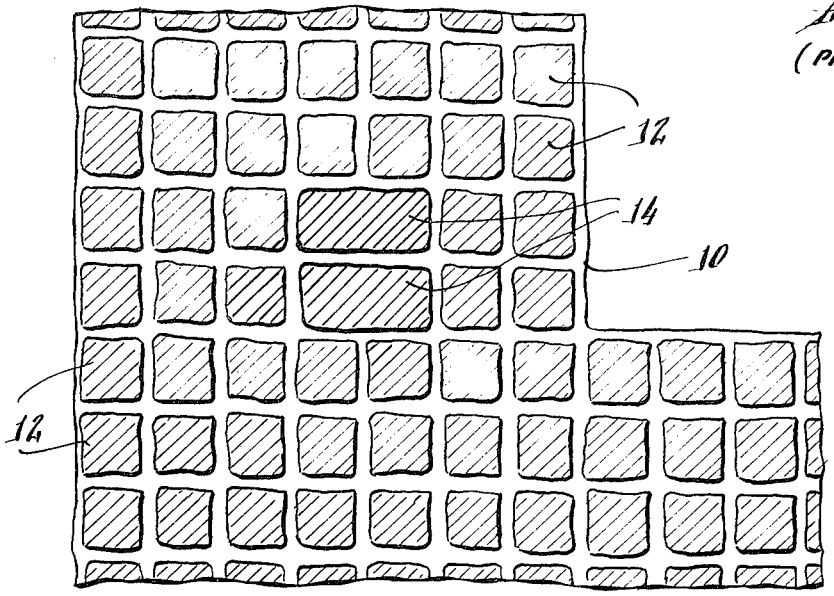
Fig. 1.
(PRIOR ART)
Fig. 2.
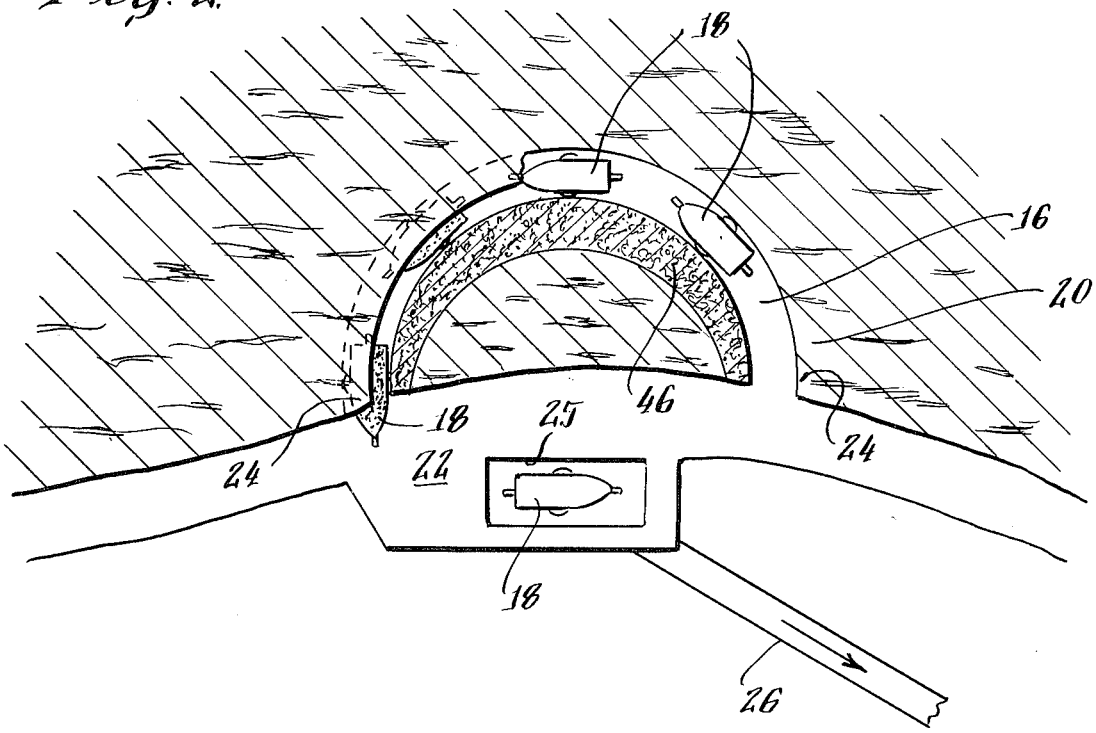

Fig. 3.
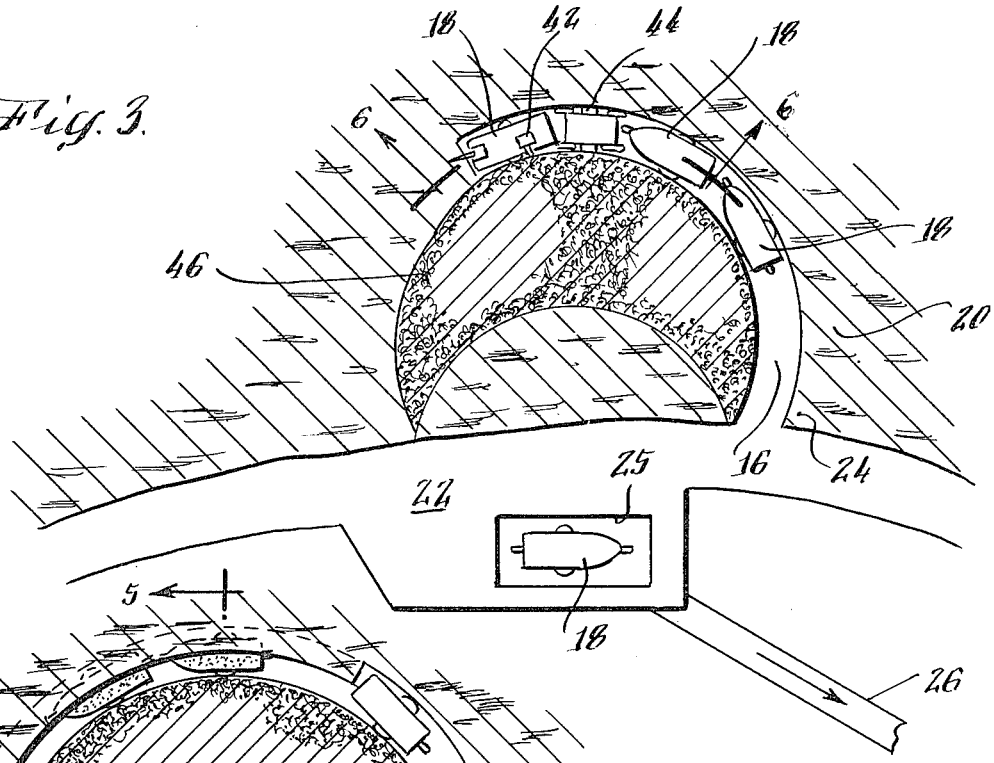
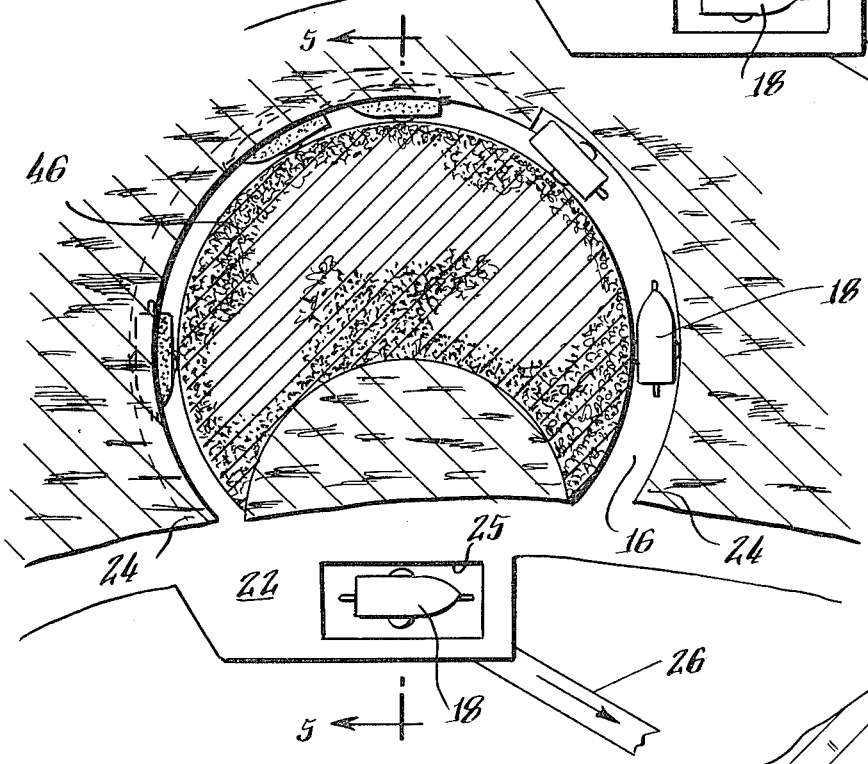
Fig. 4.
Fig. 5.
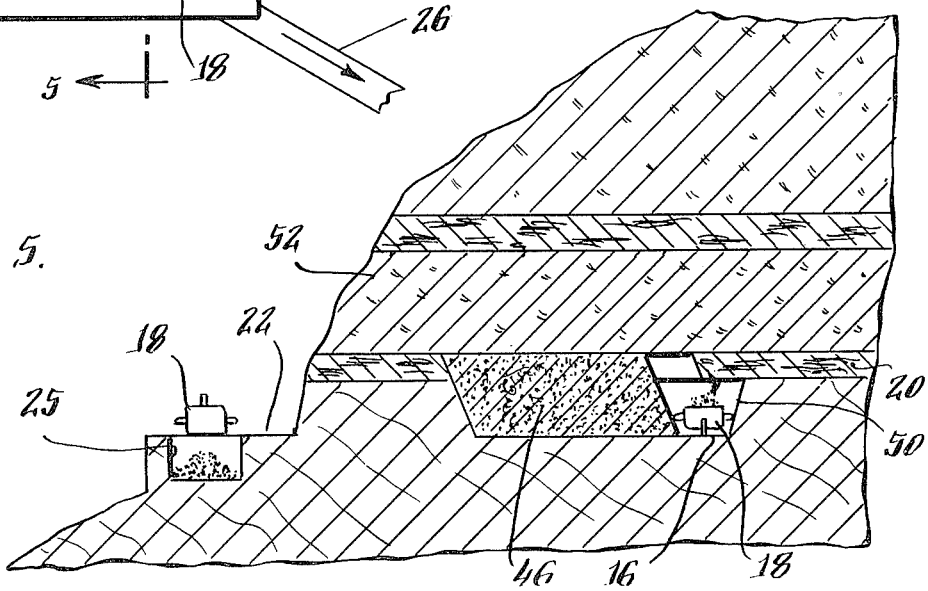

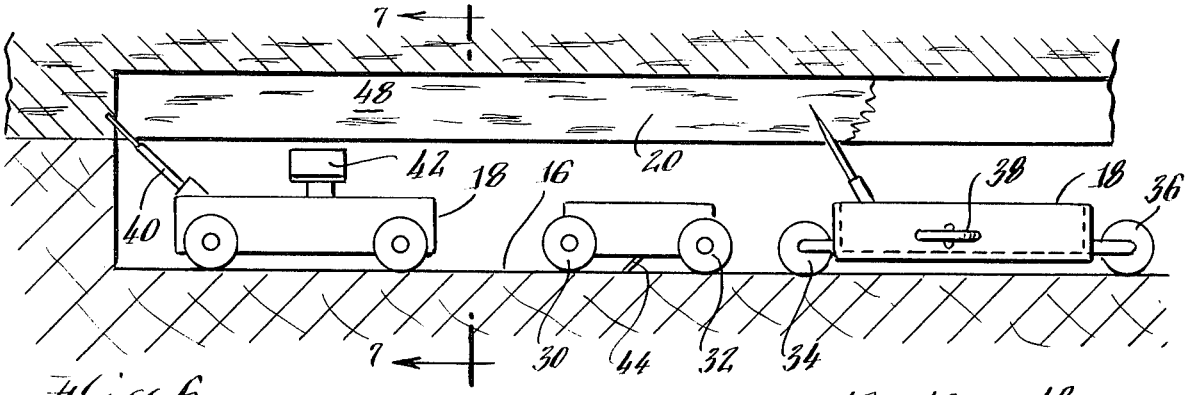
Fig. 6.
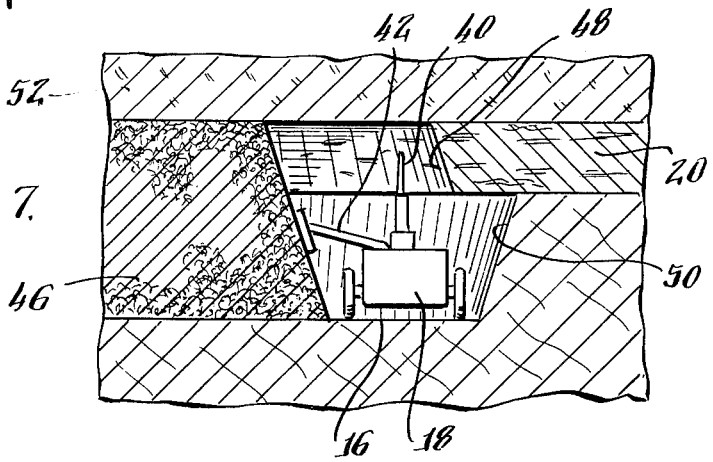
Fig. 7.
Fig. 8.
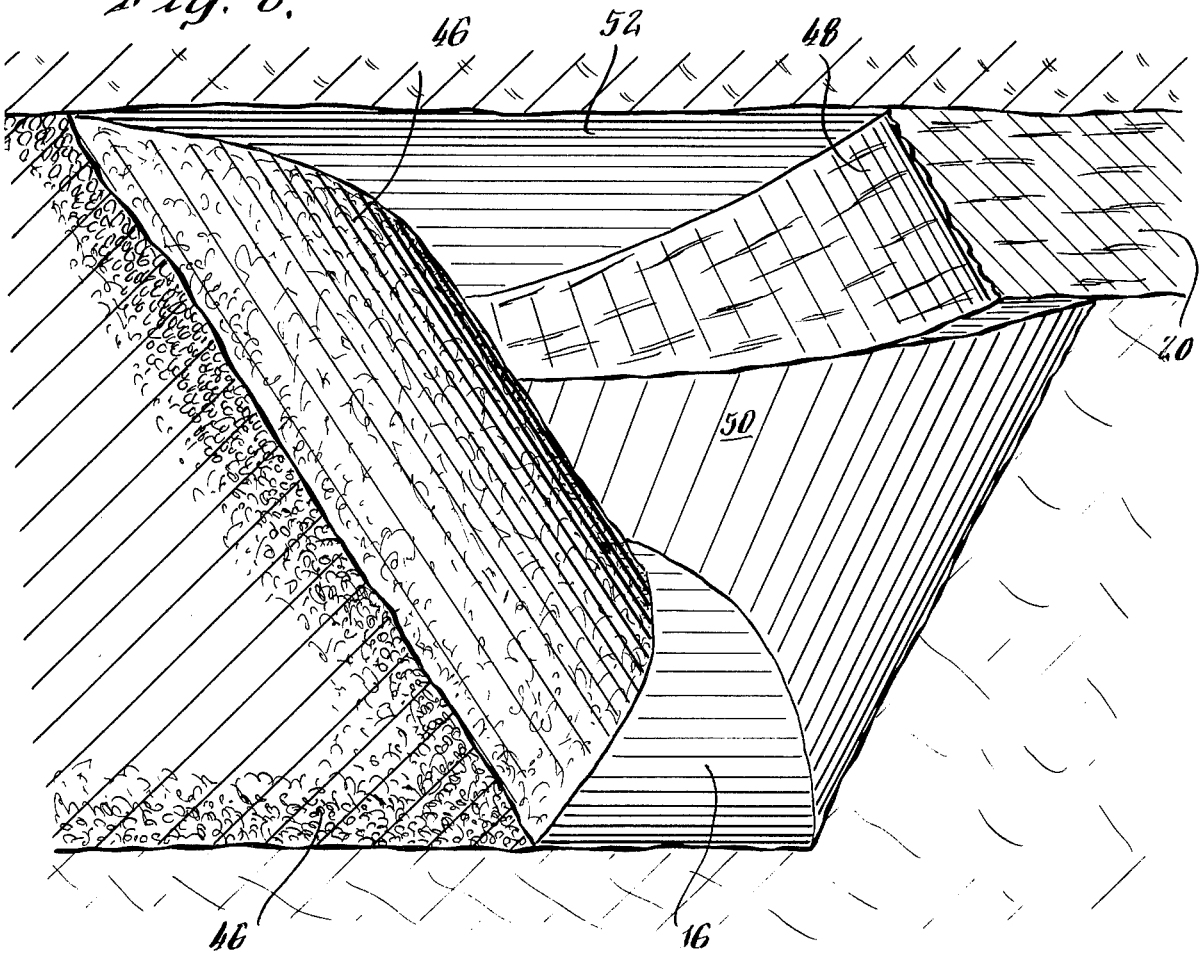

METHOD OF CIRCLE MINING OF ORE

The present invention relates to a circle mining system for deep mining in which a curved path constituting a haulage way is cut in the mountain in the form of an incomplete circle. The interrupted portion of the circle may have an above-ground processing plant and/or storage facility between the portals of the interrupted circle. The circular tunnel for the torus-like excavation has a longer perimeter which is the advancing continuous face of the mine. As coal is cut from the face and hauled outside the excavation, additional strata from below the coal, and any partings and draw rock, are shaved and graded across the haulway to be piled and packed to the ceiling, thus serving as a roof support. The inner wall on the shorter perimeter of the curved tunnel is called the soft, pack or retreat wall. It is to be understood that material may be brought in from the outside to be included as part of the soft wall, when circumstances require the same to be utilized for support.

It is an object of the present invention to provide a circular mining system which has the following advantages over the known types of mining ore, especially coal:

1. The present system raises recoverable percentages of mineable and proven reserves.
2. The present system decreases environmental impact.
3. The present system reduces operational and startup costs.
4. The present system facilitates selective mining, and thus reduces the need for washing.
5. The present system allows variable production levels without manpower change.
6. The present system makes automation with remote control possible.
7. The present system increases safety, with workers not being underground during the normal course of mining.
8. The present system permits the use of a wider range of technology.

It is emphasized that the present circular mining system can be used with existing mining equipment, however the system can be utilized with the best advantages with specially modified and new design equipment.

A feature of the present invention is the use of rock that has been cut away with the coal for roof support on the retreat side of the haulway. It is well known that when solid material is broken up, it's volume, because of air pockets thereby produced, effectively increases or swells. This characteristic can be taken advantage in the present system whereby rocks swells 35–50% when cut or blasted. Thus, when the blasted rock is replaced loose, it can fill a void left by the removal of both coal and rock.

The present invention further takes advantage of the prime objective or goal of any mining system, which is to maximize the primary functions and minimize the secondary activities. In the present case mining, which is the selective cutting and transporting of selected material, is a primary function, while the building and maintenance of roof support is a secondary activity, which is only practiced when it is necessary to maintain working and haulage space.

It is a further object of the present invention to provide haulage units which circulate in a substantially circular groove, and which take most of their guidance from the hard side, while stabilizing on the soft or retreat side.

It should be apparent that the circular mining system, as taught herein, may be regarded as an underground strip operation which can be readily adapted to automatic operation, in which weather is no longer a factor.

The prior known systems of mining coal, such as the room and pillar arrangement or long wall coal mining system, have continuous problems. In both room and pillar and long wall coal mining systems there are many injuries from roof falls, and about 50% of the mineable coal remains as roof supports.

It is a further feature of the present invention to provide a continuous mining arrangement which uses shuttle cars to haul the coal to movable belts or conveyors. This system moves in one single direction and contemplates the use of individual cars or attached cars in the form of a train which will exit out of the mine on each pass between the portals of the curved track. Furthermore, equipment is available outside of the mine for maintenance of the individual cars, if necessary. Thus, the cars operate in a closed continuous path, and the cars are capable of moving around the path, cutting the advance wall, gathering ore, hauling ore, discharging ore, grading the roadway, and packing the soft or retreat wall. Consequently, it should be evident that the car devices may be capable of classifying the coal, and loading back the rock on the car for use as packing material for the retreat wall.

It should be apparent that the present arrangement is superior to the room and pillar and long wall system of coal mining, both of which are expensive, dangerous and unclean. In addition, it should be noted that the present system lends itself to automatic operation whereby technicians at stations outside of the mining haulway can observe the mining activity on television monitors, and can control the mining activity by electronic control boxes. Thus, remote control can be applied to the present system without endangering the health and safety of miners.

In order that the invention will be more clearly understood, it will now be disclosed in greater detail with reference to the accompanying drawings, in which:

FIG. 1 is a partial top plan view of a prior art method of deep mining.

FIG. 2 is a horizontal sectional view of the circular mining method in accordance with the teachings of the present invention.

FIGS. 3 and 4 are enlarged sectional views of the mining method of the present invention during succeeding stages in the mining operation.

FIG. 5 is a vertical sectional view of the mining method shown in FIG. 2 at several levels in a mountain.

FIG. 6 is an enlarged sectional view taken along lines 6—6 of FIG. 3.

FIG. 7 is another enlarged sectional view taken along the lines 7—7 of FIG. 6, and showing one of the cars with several implements thereon, and FIG. 8 is an enlarged perspective view of the haulway and the retreat wall, as well as the coal seam on the opposite wall, with the rock underneath.

The known method of mining coal usually takes the form of the room and pillar arrangement, as seen in FIG. 1, in which a series of passageways 10 are cut in the mountainside in which coal seams are found and mined, while remaining square-like structures 12 remain as supports when mining therearound, and function as pillars to support the roof and prevent collapse of the roof over the passageways 10. Columns 14 are also used for support purposes. It is clear that at least 50% of the mineable coal remains in the pillars and columns, and are usually never utilized for obtaining ore since mine owners abandon the mine and commence mining in another location. There is also a possibility of mine collapse if the pillars are not constructed to render sufficient support for the mine roof.

FIG. 2 discloses applicant's construction and method in accordance with the present invention in which a continuous advancing path 16 is utilized to solve the problems of deep mining. In path 16 cars 18 move continuously in one direction. The cars may be connected so they move together, or may be adapted to move individually to traverse the continuous path 16. The cars 18 are of special construction which will be described in more detail hereinafter. Thus, the curved tunnel 20 gradually expands, as seen in FIGS. 3 and 4, as the deep mining proceeds laterally into the mountain. However, the curved cut in the mountain provides a path for movement in and out of the mountain to an area 22 in the form of a flat ledge adjacent to the portals 24 of the curved path or haulway 16. A receptacle 25 for receiving the coal from the mine is located in flat area 22 and the coal in the cars is dumped out of the individual cars 18 into receptacle 25, and transported away by means of conveyor belt 26.

As seen in FIGS. 5–7, the cars 18 are either provided with a set of four wheels, constituting front wheels 30 and rear wheels 32, or are provided with a single front and rear wheel 36 together with side wheels 38 which are horizontally disposed to engage the sidewalls of the haulway. In addition, the cars may contain devices, such as a pick or lance 40, a tamping unit 42 or a grader blade 44. The tamping unit may be pivotable to engage the wall 46 in order to solidly pack the retreat wall. In addition, since the deep mining operation is against an advancing wall, the mining equipment can be changed during mining, depending on what materials and conditions that are encountered as the mining progresses.

As seen in FIG. 5, deep mining can be carried out at various levels where the coal seams are, and the devices on the cars continuously pack the retreat wall from rock cut away in the curved path or, if necessary, can be hauled in from the outside and utilized in the retreat wall, which must be capable of handling heavy roof loads.

As seen in FIGS. 7 and 8, the pack or retreat wall 46 is on one side of the haulway 16 while a coal seam 48 is located on the opposite wall above an undercut stone or rock formation 50. Thus, as the coal seams and the undercut rock formations are excavated, the retreat or pack wall 46 is constantly being added to from the rock and stones taken out of the wall 50 in order to provide a continually expanding support for the roof 52 over the haulway. Consequently, the curved portion of the haulway continues to enlarge, as seen in FIGS. 3 and 4, until the particular coal seam has been completely mined.

The cars 18 are so designed and constructed that they are capable of performing the following functions:

1. Moving around the path.
2. Cutting the advance wall.
3. Gathering the mined ore.
4. Hauling the mined ore.
5. Discharging the ore.
6. Grading the roadway.
7. Packing the retreat wall.

It should be apparent that the present closed continuous curved path system of deep mining overcomes the problems of existing and previous methods. Moreover, the present method greatly simplifies the mining process, and has certain considerable advantages, not the least of which is a safety factor and the ability to mine a greater percentage of the proven ore reserves.

The possibility of adapting the present method to automatic operation should be apparent whereby the actual mining activity can be achieved by robotic devices with human control and monitoring taking place outside of the mine. Thus, the present method is particularly adaptable for remote control. In addition, the present process will result in decreased environmental impact.

What is claimed is:

1. A method of deep mining ore comprising laterally cutting a curvilinear, advancing passageway against the continuous face of the mine in a mountain by implements on a vehicle traveling in one direction, providing a work area adjacent to the portals of said passageway at the entrance and exit thereof whereby said vehicle traverses a substantially circular path partially within the passageway in said mountain and partially outside of said mountain over said work area, and said implements on said vehicle being adapted to cut ore from the rock formation on one side wall of said passageway, and means to pack the excavated loose rock on the opposite retreating wall to form a support for the roof of the mine, when needed.

2. A method as claimed in claim 1 wherein said ore is coal.

3. A method of deep mining ore comprising laterally cutting a first curvilinear, advancing passageway against the continuous face of the mine in a mountain by implements on a vehicle traveling in one direction, providing a work area adjacent to the portals of said passageway at the entrance and exit thereof whereby said vehicle traverses a substantially circular path partially within the passageway in said mountain and partially outside of said mountain over said work area, said implements on said vehicles being adapted to cut ore from the rock formation on one side of the wall of the passageway, and means to pack the excavated loose rock on the opposite retreating wall to form a support for the roof of the mine, when needed, and repeating the step of cutting a second curvilinear advancing passageway in the mountain concentrically with said first curvilinear passageway by implements on said vehicle.

4. A method as claimed in claim 1 and further providing a dumping site on said work area for said ore gathered in the mining operation.

5. A method of deep mining ore as claimed in claim 3 wherein a series of curvilinear passageways are cut in the mountain at different substantially horizontal levels.

* * * * *